US009756446B2

(12) United States Patent
Johnson et al.

(10) Patent No.: US 9,756,446 B2
(45) Date of Patent: Sep. 5, 2017

(54) ROBUST CROSSTALK CANCELLATION USING A SPEAKER ARRAY

(71) Applicant: Apple Inc., Cupertino, CA (US)

(72) Inventors: Martin E. Johnson, Los Gatos, CA (US); Ronald N. Isaac, San Ramon, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/773,280

(22) PCT Filed: Mar. 13, 2014

(86) PCT No.: PCT/US2014/026503

§ 371 (c)(1),
(2) Date: Sep. 4, 2015

(87) PCT Pub. No.: WO2014/151817

PCT Pub. Date: Sep. 25, 2014

(65) Prior Publication Data

US 2016/0021480 A1 Jan. 21, 2016

Related U.S. Application Data

(60) Provisional application No. 61/782,287, filed on Mar. 14, 2013.

(51) Int. Cl.
*H04R 5/02* (2006.01)
*H04S 7/00* (2006.01)
(Continued)

(52) U.S. Cl.
CPC ..... *H04S 7/301* (2013.01); *H04R 5/02* (2013.01); *H04R 5/04* (2013.01); *H04S 3/02* (2013.01);
(Continued)

(58) Field of Classification Search
USPC ..... 381/26, 85, 94.7, 99, 300, 307, 309; 379/3, 406.01, 406.05
See application file for complete search history.

(56) References Cited

U.S. PATENT DOCUMENTS 9,549,245 B2 * 1/2017 Frater ..... H04R 27/00
2003/0065513 A1 * 4/2003 Kaminuma ..... G10L 21/02 704/266

FOREIGN PATENT DOCUMENTS

JP 2003-174699 6/2003
JP 2008-227804 9/2008
(Continued)

OTHER PUBLICATIONS

PCT International Preliminary Report on Patentability for PCT International Appln No. PCT/US2014/026503 mailed on Sep. 24, 2015 (10 pages).
(Continued)

*Primary Examiner* — Yosef K Laekemariam
(74) *Attorney, Agent, or Firm* — Blakely, Sokoloff, Taylor & Zafman LLP

(57) ABSTRACT

An audio receiver that performs crosstalk cancellation using a speaker array is described. The audio receiver detects the location of a listener in a room and processes a piece of sound program content to be output through the speaker array using one or more beam pattern matrices. The beam pattern matrices are generated according to one or more constraints. The constraints may include increasing a right channel and decreasing a left channel at the right ear of the listener, increasing a left channel and decreasing a right channel at the left ear of the listener, and decreasing sound in all other areas of the room. These constraints cause the audio receiver to beam sound primarily towards the listener and not in other areas of the room such that crosstalk cancellation is achieved with minimal effects due to changes to the frequency response of the room. Other embodiments are also described.

28 Claims, 10 Drawing Sheets

(51) Int. Cl.
*H04R 5/04* (2006.01)
*H04S 3/02* (2006.01)

(52) U.S. Cl.
CPC ..... *H04S 7/303* (2013.01); *H04R 2203/12* (2013.01); *H04S 2400/15* (2013.01); *H04S 2420/01* (2013.01)

(56) References Cited

FOREIGN PATENT DOCUMENTS

WO WO 2012/068174 A2 5/2012
WO WO-2012068174 5/2012

OTHER PUBLICATIONS

Australian Patent Examination Report No. 1 (dated Dec. 14, 2015), Application No. 2014236850, Earliest Priority Date: Mar. 14, 2013, 3 pages.
Korean Notice of Preliminary Rejections (Dated Jun. 16, 2016), Application No. 10-2015-7025182, Date Filed Mar. 13, 2014, 11 Pages.
Chinese Office Action with English Language Translation, dated Aug. 9, 2016, Chinese Application No. 201480022597.8.
Japanese Office Action mailed Sep. 20, 2016 for Japanese Patent Application No. 2016-502158 with English translation.
PCT International Search Report and Written Opinion for PCT International Appln No. PCT/US2014/026503 filed on Mar. 13, 2014 (12 pages).

* cited by examiner

ROBUST CROSSTALK CANCELLATION USING A SPEAKER ARRAY

RELATED MATTERS

This application is a U.S. National Phase Application under 35 U.S.C. §371 of International Application No. PCT/US2014/026503, filed Mar. 13, 2014, which claims the benefit of the earlier filing date of U.S. provisional application No. 61/782,287, filed Mar. 14, 2013, and this application hereby incorporates herein by reference these previous patent applications.

FIELD

An audio receiver that performs crosstalk cancellation using a speaker array by achieving one or more constraints is described. Other embodiments are also described.

BACKGROUND

A single loudspeaker may create sound at both ears of a listener. For example, a loudspeaker on the left side of a listener will still generate some sound at the right ear of the listener. The objective of a crosstalk canceler is to allow production of sound at one of the listener's ears without generating sound at the other ear. This isolation allows any arbitrary sound to be generated at one ear without bleeding to the other ear. Controlling sound at each ear independently can be used to create the impression that the sound is coming from a location away from the loudspeaker.

In principle a crosstalk canceler requires only two speakers (i.e., two degrees of freedom) to control the sound at two ears separately. Many crosstalk cancellers control sound at the ears of a listener by compensating for effects generated by sound diffracting around the listener's head, commonly known as Head Related Transfer Functions (HRTFs). Given a right audio input channel $d_R$ and a left audio input channel $d_L$, the crosstalk canceler may be represented as:

$$\begin{bmatrix} f_R \\ f_r \end{bmatrix} = [H][H^{-1}]\begin{bmatrix} d_R \\ d_L \end{bmatrix}$$

In this equation, the transfer function of the listener's head due to sound coming from the loudspeaker H is compensated for by the inverse of the transfer function $H^{-1}$ to produce a right output channel $f_R$ and a left output channel $f_L$ at the right and left ears of the listener, respectively. Many crosstalk cancelers that use only two speakers suffer from ill-conditioning at some frequencies. For example, the loudspeakers in these systems need to be driven with large signals to achieve crosstalk cancellation and are very sensitive to changes from ideal. In other words, if the system is designed using an assumed transfer function H representing propagation of sound from the loudspeakers to the listener's ears, small changes in H can cause the crosstalk canceler to stop working One example of this is when the transfer function H is measured in an anechoic environment (i.e., no acoustic reflections), but is then implemented in a real room where there are many reflections.

SUMMARY

An embodiment of the invention is an audio receiver that performs crosstalk cancellation using a speaker array with a plurality of transducers. The audio receiver detects the location of a listener in a room or listening area and then processes a piece of sound program content to be output through the speaker array using one or more beam pattern matrices that correspond to the detected location of the listener. The beam pattern matrices each correspond to a particular audio frequency and are generated according to one or more constraints and may be preset in the audio receiver. The constraints may include (1) maximizing/increasing a left channel and minimizing/decreasing a right channel of a piece of sound program content at the left ear of the listener, (2) maximizing/increasing the right channel and minimizing/decreasing the left channel at the right ear of the listener, and (3) minimizing/decreasing sound in all other areas of the room. These constraints cause the audio receiver to beam sound primarily towards the listener. By beaming sound towards the listener and not in other areas of the room, crosstalk cancellation is achieved with minimal effects or reduced impact due to changes to the frequency response of the room.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1A:
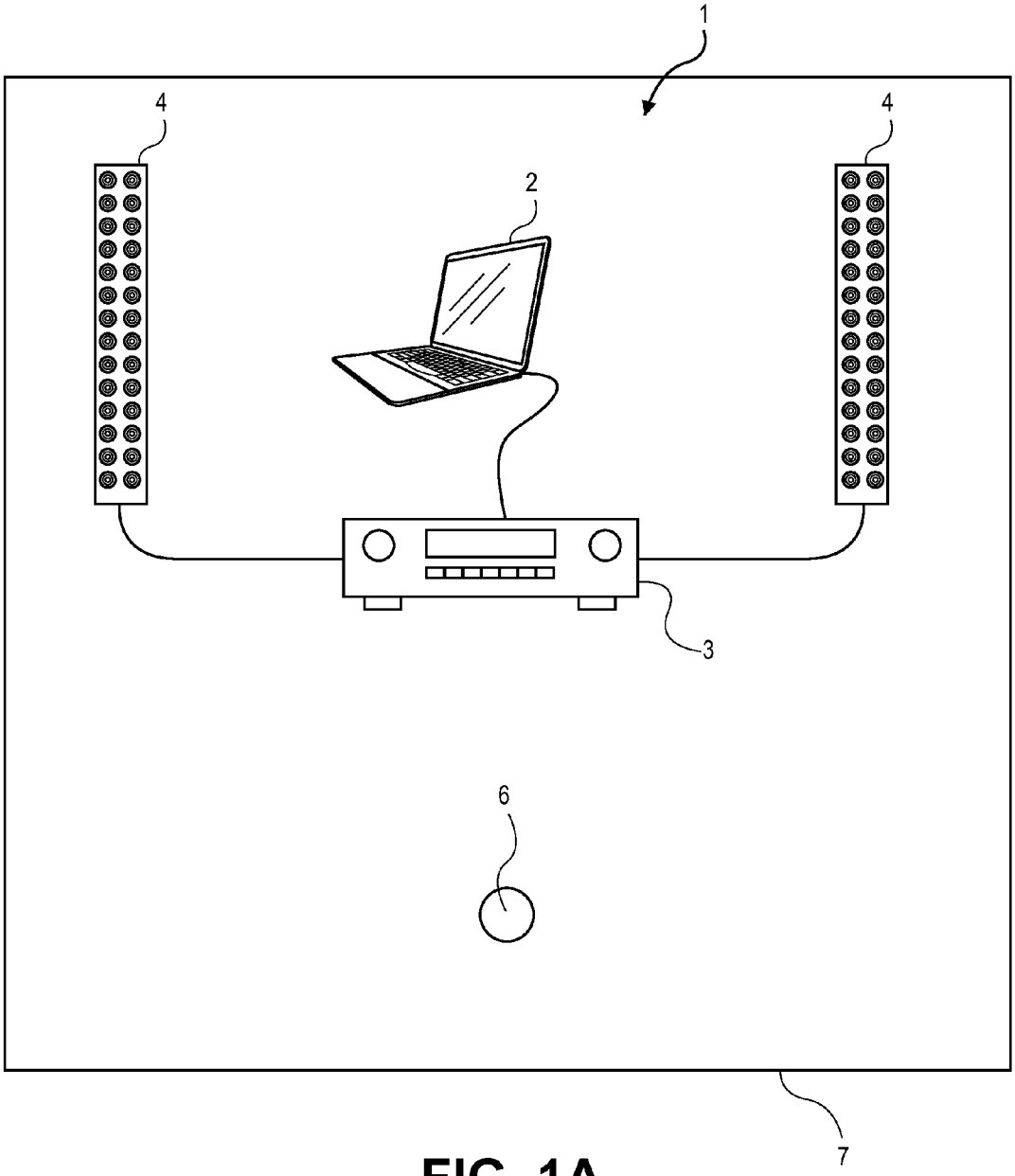
FIG. 1A shows a room or listening area with an audio system according to one embodiment.

FIG. 1A shows an audio system 1 that includes an external audio source 2, an audio receiver 3, and one or more loudspeaker arrays 4. The audio system 1 outputs sound program content into a room or listening area 7 in which an intended listener 6 is located. The listener 6 is traditionally seated at a target location at which the audio system 1 is primarily directed or aimed. The target location is typically in the center of the room 7, but may be in any designated area of the room 7.

The external audio source 2 may be any device capable of transmitting one or more audio streams representing sound program content to the audio receiver 3 for processing. For example, the external audio source 2 in the system 1 of FIG. 1A is a laptop computer that transmits one or more audio streams representing sound program content to the audio receiver 3 for processing either through wired or wireless connections. In other embodiments, the external audio source 2 may instead be one or more of a desktop computer, a tablet computer, a mobile device (e.g., a mobile phone or mobile music player), and a remote media server (e.g., an Internet streaming music or movie service).

As shown in FIG. 1A, the components of the audio system 1 are distributed and contained in separate units. In contrast, as shown in the embodiment of the audio system 1 of FIG. 1B, the audio receiver 3 is integrated within the loudspeakers array 4 to provide a standalone unit. In this embodiment, the loudspeaker array 4 receives one or more audio streams representing sound program content directly from the external audio source 2 either through wired or wireless connections.

Although described as receiving audio streams from an external audio source 2, the audio receiver 3 may access audio streams locally stored in a storage medium. In this embodiment, the audio receiver 3 retrieves the audio streams from the local storage medium for processing without interaction with an external audio source 2.

As will be described in further detail below, the audio receiver 3 may be any type of device or set of devices for processing streams of audio and driving one or more loudspeaker arrays 4. For example, the audio receiver 3 may be a laptop computer, a desktop computer, a tablet computer, a mobile device, or a home theatre audio receiver.

Figure 2A:
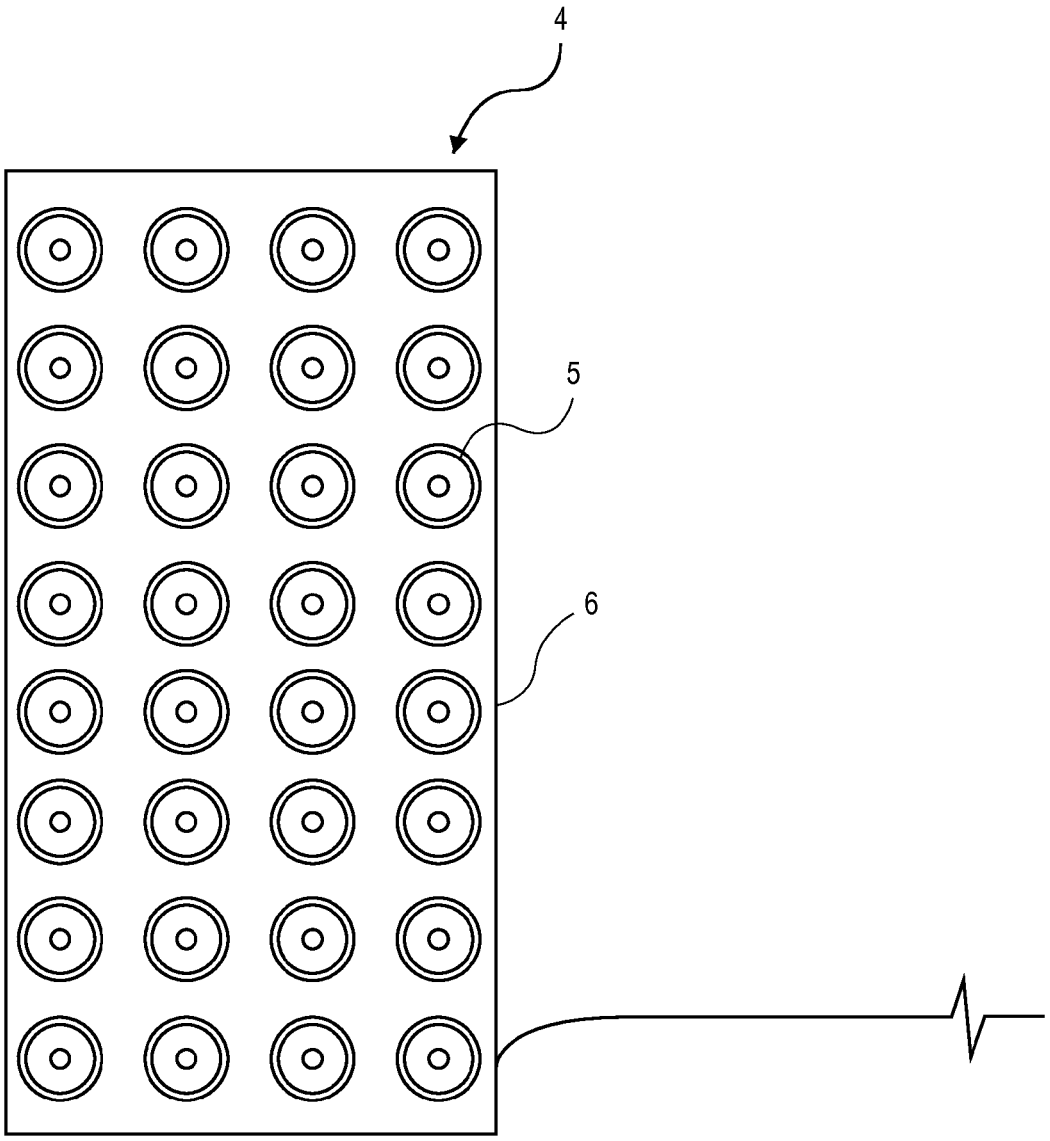
FIG. 2A shows a loudspeaker array housed in a single cabinet according to one embodiment.
Figure 2B:
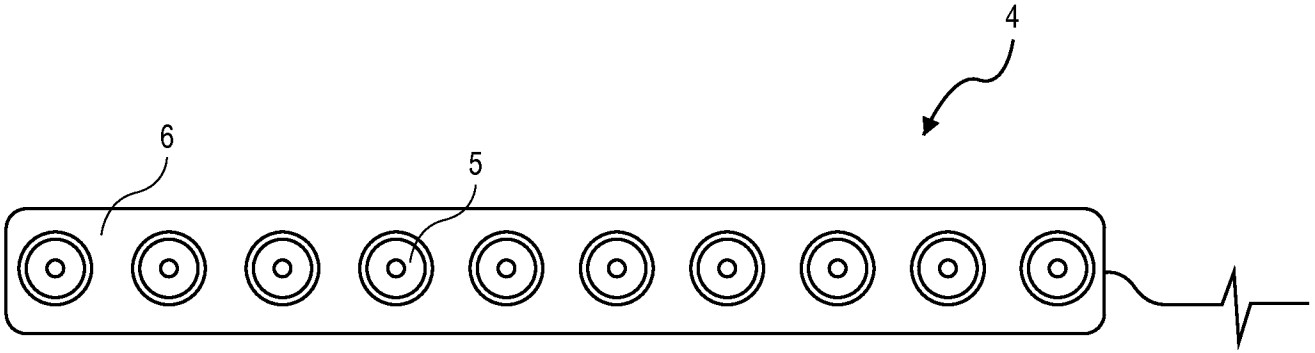
FIG. 2B shows a loudspeaker array housed in a single cabinet according to another embodiment.

Turning now to the loudspeaker arrays 4, FIG. 2A shows one speaker array 4 with multiple transducers 5 housed in a single cabinet 6. In this example, the speaker array 4 has 32 distinct transducers 5 evenly aligned in eight rows and four columns within the cabinet 6. In other embodiments, different numbers of transducers 5 may be used with uniform or non-uniform spacing. For instance, as shown in FIG. 2B, ten transducers 5 may be aligned in a single row in the cabinet 6 to form a sound-bar style speaker array 4. Although shown as aligned in a flat plane or straight line, the transducers 5 may be aligned in a curved fashion along an arc.

The transducers 5 may be any combination of full-range drivers, mid-range drivers, subwoofers, woofers, and tweeters. Each of the transducers 5 may use a lightweight diaphragm, or cone, connected to a rigid basket, or frame, via a flexible suspension that constrains a coil of wire (e.g., a voice coil) to move axially through a cylindrical magnetic gap. When an electrical audio signal is applied to the voice coil, a magnetic field is created by the electric current in the voice coil, making it a variable electromagnet. The coil and the transducers' 5 magnetic system interact, generating a mechanical force that causes the coil (and thus, the attached cone) to move back and forth, thereby reproducing sound under the control of the applied electrical audio signal coming from a source (e.g., a signal processor, a computer, and an audio receiver). Although described herein as having multiple transducers 5 housed in a single cabinet 6, in other embodiments the speaker array 4 may include a single transducer 5 housed in the cabinet 6. In these embodiments, the speaker array 4 is a standalone loudspeaker.

Each transducer 5 may be individually and separately driven to produce sound in response to separate and discrete audio signals. By allowing the transducers 5 in the speaker array 4 to be individually and separately driven according to different parameters and settings (including delays and energy levels), the speaker array 4 may produce numerous directivity patterns to simulate or better represent respective channels of sound program content played to a listener 6. For example, beam patterns of different widths and directivities may be emitted by the speaker array 4.

As shown in FIG. 1A, the speaker arrays 4 may include wires or conduit for connecting to the audio receiver 3. For example, each speaker array 4 may include two wiring points and the audio receiver 3 may include complementary wiring points. The wiring points may be binding posts or spring clips on the back of the speaker arrays 4 and the audio receiver 3, respectively. The wires are separately wrapped around or are otherwise coupled to respective wiring points to electrically couple the speaker arrays 4 to the audio receiver 3.

Figure 1B:
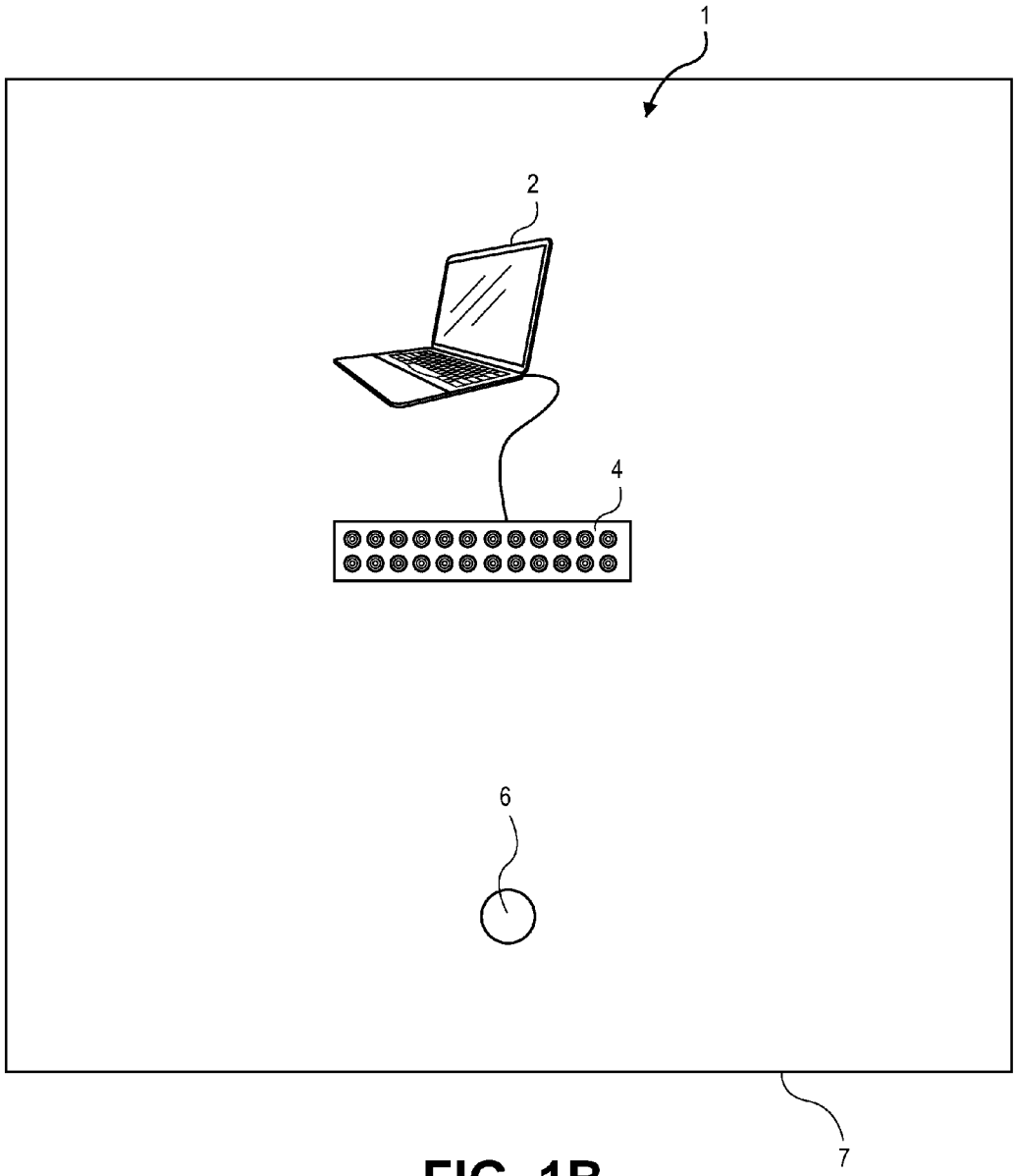
FIG. 1B shows a room or listening area with an audio system according to another embodiment.

In other embodiments, as shown in FIG. 1B, the speaker array 4 may be coupled to the audio receiver 3 using wireless protocols such that the array 4 and the audio receiver 3 are not physically joined but maintain a radio-frequency connection. For example, the speaker array 4 may include a WiFi receiver for receiving audio signals from a corresponding WiFi transmitter in the audio receiver 3. In some embodiments, the speaker array 4 may include integrated amplifiers for driving the transducers 5 using the wireless audio signals received from the audio receiver 3. As noted above, the speaker array 4 may be a standalone unit that includes components for signal processing and for driving each transducer 5 according to the techniques described below.

Although shown in FIG. 1A as including two speaker arrays 4, the audio system 1 may include any number of speaker arrays 4 that are coupled to the audio receiver 3 through wireless or wired connections. For example, the audio system 1 may include six speaker arrays 4 that represent a front left channel, a front center channel, a front right channel, a rear right surround channel, a rear left surround channel, and a low frequency channel (e.g., a subwoofer). In another embodiment, the audio system 1 may include a single speaker array 4, as shown in FIG. 1B. This single speaker array 4 may be a sound bar style speaker array.

Figure 3:
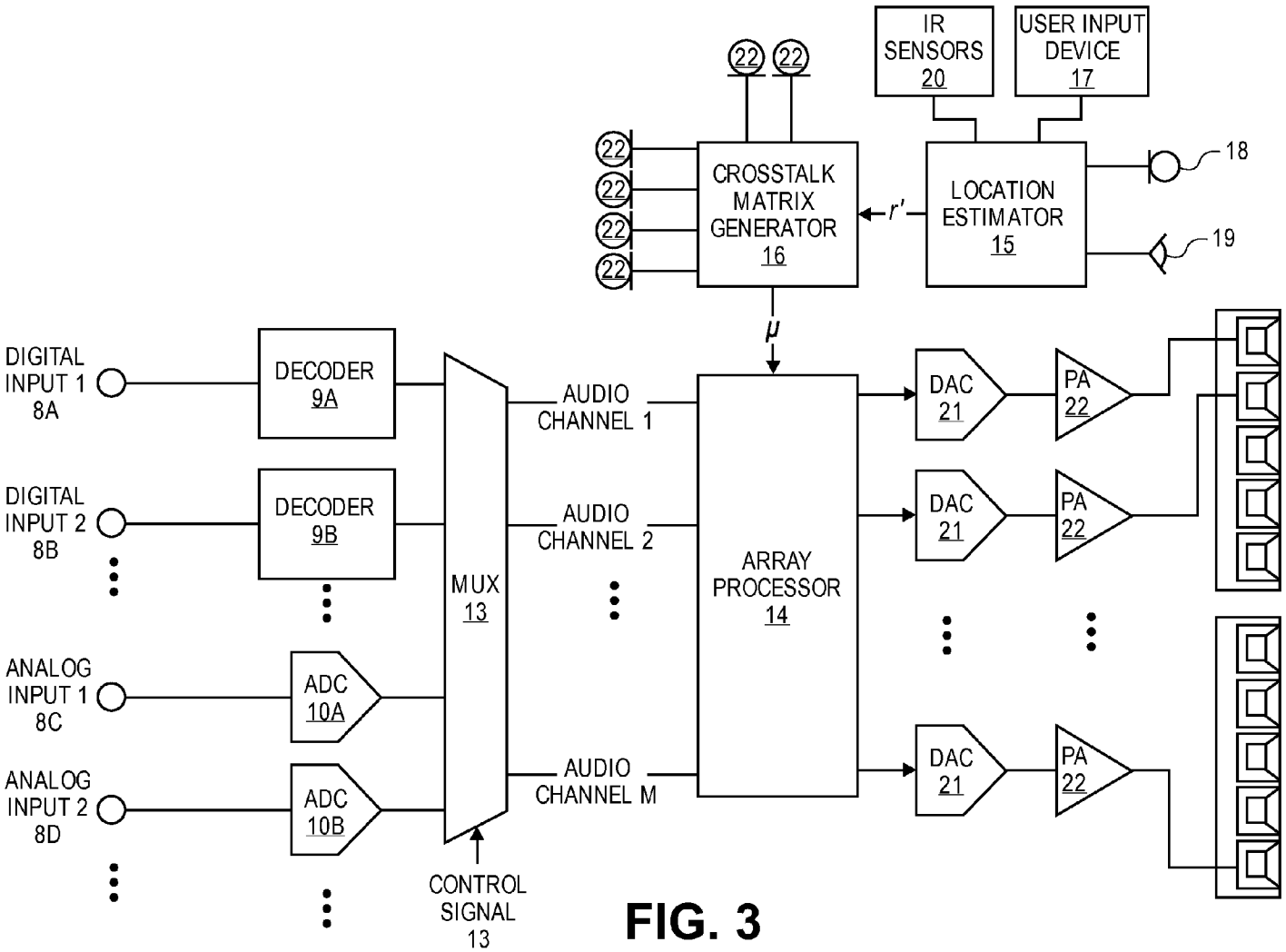
FIG. 3 shows a functional unit block diagram and some constituent hardware components of an audio receiver according to one embodiment.

FIG. 3 shows a functional unit block diagram and some constituent hardware components of the audio receiver 3 according to one embodiment. The components shown in FIG. 3 are representative of elements included in the audio receiver 3 and should not be construed as precluding other components. Each element of FIG. 3 will be described by way of example below.

The audio receiver 3 may include multiple inputs 8 for receiving one or more channels of sound program content using electrical, radio, or optical signals from one or more external audio sources 2. The inputs 8 may be a set of digital inputs 8A and 8B and analog inputs 8C and 8D including a set of physical connectors located on an exposed surface of the audio receiver 3. For example, the inputs 8 may include a High-Definition Multimedia Interface (HDMI) input, an optical digital input (TOSLINK), a coaxial digital input, and a phono input. In one embodiment, the audio receiver 3 receives audio signals through a wireless connection with an external audio source 2. In this embodiment, the inputs 8 include a wireless adapter for communicating with the external audio source 2 using wireless protocols. For example, the wireless adapter may be capable of communicating using BLUETOOTH, IEEE 802.11x, cellular Global System for Mobile Communications (GSM), cellular Code division multiple access (CDMA), or Long Term Evolution (LTE).

As shown in FIG. 1A and FIG. 1B and described above, the external audio source 2 may be a laptop computer or any device capable of transmitting one or more channels of sound program content to the audio receiver 3 over a wireless or wired connection. In one embodiment, the external audio source 2 and the audio receiver 3 are integrated in one indivisible unit. In this embodiment, the loudspeaker array 4 may also be integrated into the same unit. For example, the external audio source 2 and the audio receiver 3 may be in one computing unit with transducers 5 integrated in left and right sides of the unit.

Returning to the audio receiver 3, general signal flow from the inputs 8 will now be described. Looking first at the digital inputs 8A and 8B, upon receiving a digital audio signal through the input 8A and/or 8B, the audio receiver 3 uses a decoder 9A or 9B to decode the electrical, optical, or radio signals into a set of audio channels representing sound program content. For example, the decoder 9A may receive a single signal containing six audio channels (e.g., a 5.1 signal) and decode the signal into six audio channels. The decoders 9 may be capable of decoding an audio signal encoded using any codec or technique, including Advanced Audio Coding (AAC), MPEG Audio Layer II, MPEG Audio Layer III, and Free Lossless Audio Codec (FLAC).

Turning to the analog inputs 8C and 8D, each analog signal received by analog inputs 8C and 8D may represent a single audio channel of the sound program content. Accordingly, multiple analog inputs 8C and 8D may be needed to receive each channel of a piece of sound program content. The audio channels may be digitized by respective analog-to-digital converters 10A and 10B to form digital audio channels.

The digital audio channels from each of the decoders 9A and 9B and the analog-to-digital converters 10A and 10B are output to the multiplexer 12. The multiplexer 12 selectively outputs a set of audio channels based on a control signal 13. The control signal 13 may be received from a control circuit or processor in the audio receiver 3 or from an external device. For example, a control circuit controlling a mode of operation of the audio receiver 3 may output the control signal 13 to the multiplexer 12 for selectively outputting a set of digital audio channels.

The multiplexer 12 feeds the selected digital audio channels to an array processor 14. The channels output by the multiplexer 12 are processed by the array processor 14 to produce a set of processed audio channels. The processing may operate in both the time and frequency domains using transforms such as the Fast Fourier Transform (FFT. The array processor 14 may be a special purpose processor such as application-specific integrated circuit (ASICs), a general purpose microprocessor, a field-programmable gate array (FPGA), a digital signal controller, or a set of hardware logic structures (e.g., filters, arithmetic logic units, and dedicated state machines). The array processor 14 generates a set of signals for driving the transducers 5 in the speaker arrays 4 based on inputs from a location estimator 15 and/or crosstalk matrix generator 16.

Figure 4A:
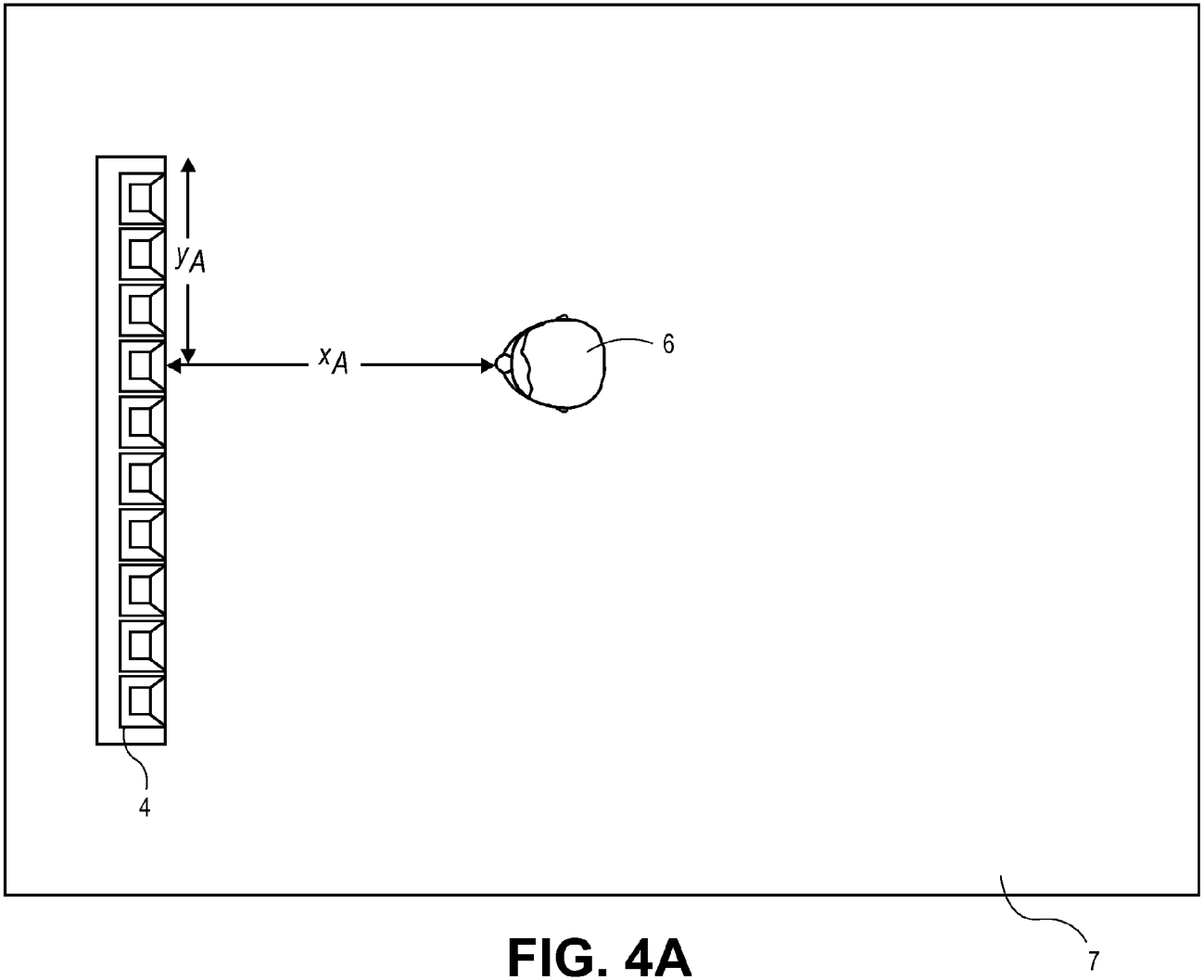
FIG. 4A shows a listener at a first location in the room.

The location estimator 15 determines the location of one or more human listeners in the room 7. For example, the location estimator 15 may determine the physical coordinates of the listener 6 in the room 7 or the location of the listener 6 relative to the speaker array 4 (e.g., distance and angle or coordinates relative to the speaker array 4). FIG. 4A shows the listener 6 at a location in the room 7 with coordinates $x_A$, $y_A$, relative to the speaker array 4. The location estimator 15 determines the location of the listener 6 as the listener 6 moves around the room 7 and while sound is being emitted by the speaker array 4. Although described in relation to a single listener 6, the location estimator 15 may determine the location of multiple listeners 6 in the room 7. Although the location estimator 15 described herein adaptively determines the location of the listener 6 in the room 7, in one embodiment the location estimator assumes the location of the listener 6 is fixed after an initial location determination.

Figure 4B:
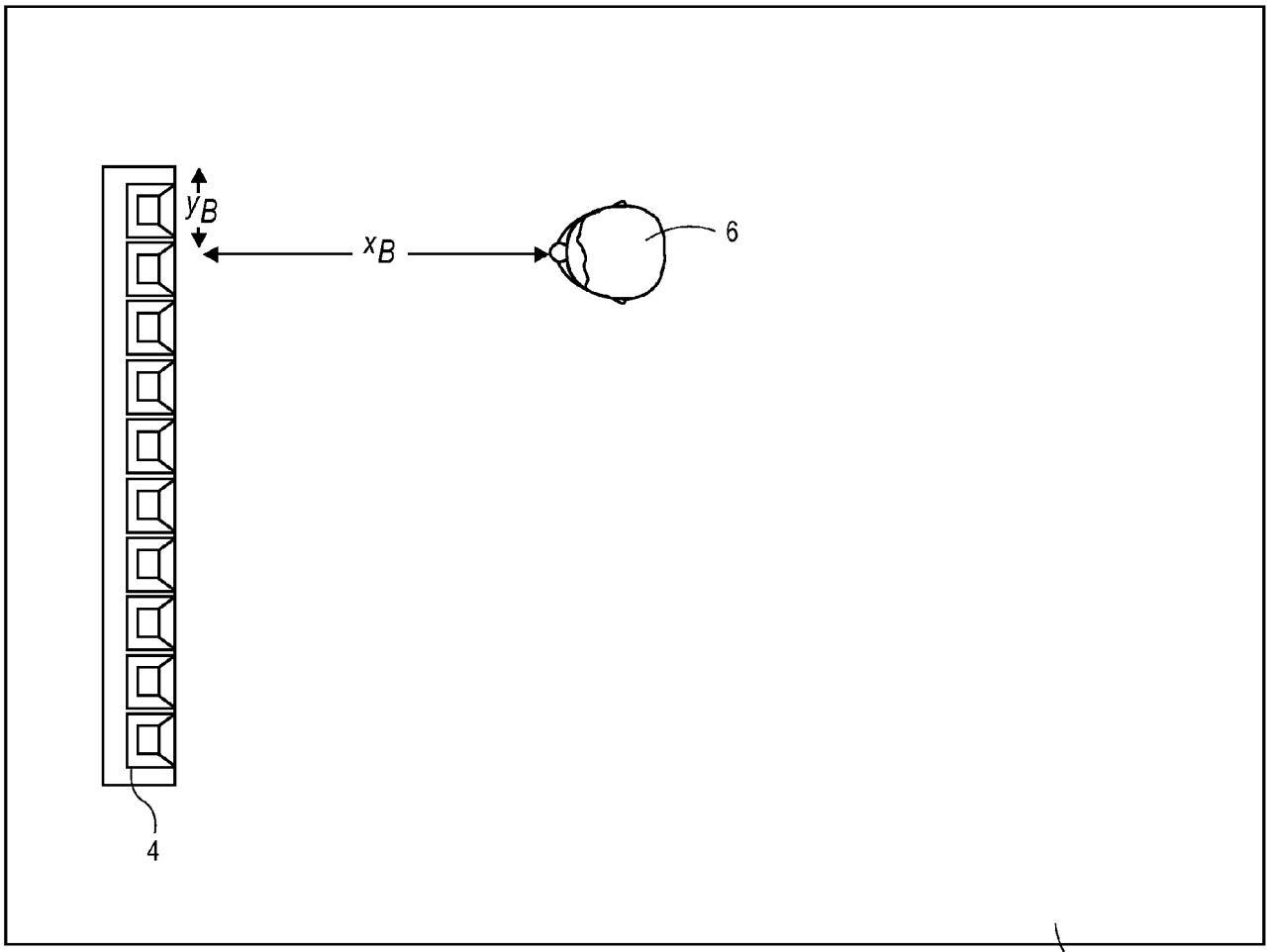
FIG. 4B shows the listener at a second location in the room.

The location estimator 15 may use any device or algorithm for determining the location of the listener 6. In one embodiment, a user input device 17 is coupled to the location estimator 15 for assisting in determining the location of the listener 6. The user input device 17 allows the listener 6 to periodically enter the location of the listener 6 relative to the speaker array 4 or another known object in the room 7. For example, while watching a movie the listener 6 may initially be seated on a couch with coordinates $x_A$, $y_A$, relative to the speaker array 4 as shown in FIG. 4A. The listener 6 may enter this location into the location estimator 15 using the user input device 17. Midway through the movie, the listener 6 may decide to move to a table located at $X_B$, $y_B$, relative to the speaker array 4 as shown in FIG. 4B. Based on this movement, the listener 6 may enter this new location into the location estimator 15 using the user input device 17. The user input device 17 may be a wired or wireless keyboard, a mobile device, or any other similar device that allows the listener 6 to enter in a location into the location estimator 15. In one embodiment, the entered value is a non-numerical or relative value. For example, the listener 6 may indicate that they are located on the right side of the speaker array 4.

In another embodiment, a microphone 18 may be coupled to the location estimator 15 for assisting in determining the location of the listener 6. In this embodiment, the microphone 18 is located with the listener 6 or proximate to the listener 6. The audio receiver 3 drives the speaker array 4 to emit a set of test sounds that are sensed by the microphone 18 and fed to the location estimator 15 for processing. The location estimator 15 determines the propagation delay of the test sounds as they travel from the speaker array 4 to the microphone 18 based on the sensed sounds. The propagation delay may thereafter be used to determine the location of the listener 6 relative to the speaker array 4.

The microphone 18 may be coupled to the location estimator 15 using a wired or wireless connection. In one embodiment, the microphone 18 is integrated in a mobile device (e.g., a mobile phone) and the sensed sounds are transmitted to the location estimator 15 using one or more wireless protocols (e.g., BLUETOOTH and IEEE 802.11x). The microphone 18 may be any type of acoustic-to-electric transducer or sensor, including a MicroElectrical-Mechanical System (MEMS) microphone, a piezoelectric microphone, an electret condenser microphone, or a dynamic microphone. The microphone 18 may provide a range of polar patterns, such as cardioid, omnidirectional, and figure-eight. In one embodiment, the polar pattern of the microphone 18 may vary continuously over time. Although shown and described as a single microphone 18, in one embodiment, multiple microphones or microphone arrays may be used for detecting sounds in the room 7.

In another embodiment, a camera 19 may be coupled to the location estimator 15 for assisting in determining the location of the listener 6. The camera 19 may be a video camera or still-image camera that is pointed in the same direction as the speaker array 4 into the room 7. The camera 19 records a video or set of still images of the area in front of the speaker array 4. Based on these recordings, the camera 19 alone or in conjunction with the location estimator 15 tracks the face or other body parts of the listener 6. The location estimator 15 may determine the location of the listener 6 based on this face/body tracking. In one embodiment, the camera 19 tracks features of the listener 6 periodically while the speaker array 4 outputs sound program content such that the location of the listener 6 may be updated and remain accurate. For example, the camera 19 may track the listener 6 continuously while a song is being played through the speaker array 4.

The camera 19 may be coupled to the location estimator 15 using a wired or wireless connection. In one embodiment, the camera 19 is integrated in a mobile device (e.g., a mobile phone) and the recorded videos or still images are transmitted to the location estimator 16 using one or more wireless protocols (e.g., BLUETOOTH and IEEE 802.11x). Although shown and described as a single camera 19, in one embodiment, multiple cameras may be used for face/body tracking.

In still another embodiment, one or more infrared (IR) sensors 20 are coupled to the location estimator 15. The IR sensors 20 capture IR light radiating from objects in the area in front of the speaker array 4. Based on these sensed IR readings, the location estimator 15 may determine the location of the listener 6. In one embodiment, the IR sensors 20 periodically operate while the speaker array 4 outputs sound such that the location of the listener 6 may be updated and remain accurate. For example, the IR sensors 20 may track the listener 6 continuously while a song is being played by through the speaker array 4.

The infrared sensors 20 may be coupled to the location estimator 15 using a wired or wireless connection. In one embodiment, the infrared sensors 20 are integrated in a mobile device (e.g., a mobile phone) and the sensed infrared light readings are transmitted to the location estimator 15 using one or more wireless protocols (e.g., BLUETOOTH and IEEE 802.11x).

Although described above in relation to a single listener 6, in one embodiment the location estimator 15 may determine the location of multiple listeners 6 relative to the speaker array 4. In this embodiment, each of the locations of the listeners 6 is used to adjust sound emitted by the speaker array 4.

Using any combination of techniques described above, the location estimator 15 calculates and feeds the location of the listener 6 to the crosstalk matrix generator 16 for processing. The crosstalk matrix generator 16 retrieves a beam pattern matrix based on the detected location of the listener 6. The retrieved beam pattern matrices achieve one or more predefined constraints for emitting sound through the speaker array 4. In one embodiment, the constraints include (1) maximizing/increasing a left channel and minimizing/decreasing a right channel of a piece of sound program content at the left ear of the listener 6, (2) maximizing/increasing the right channel and minimizing/decreasing the left channel at the right ear of the listener 6, (3) and minimizing/decreasing sound in all other areas of the room 7. The method for generating the beam pattern matrices will be described in more detail below.

In one embodiment, maximizing/increasing a first channel while minimizing a second channel at one ear may include increasing the perceived sound of the first channel at the ear while decreasing or eliminating the second channel at the ear. This perception may be defined by the power of the first channel being significantly greater than the power of the second channel.

Given a right audio input channel $d_R$ and a left audio input channel $d_L$, the beam pattern matrices produce a right output channel $f_R$ and a left output channel $f_L$ at the right and left ears of the listener, respectively. This may be represented by the following equation, where G is a beam pattern matrix:

$$\begin{bmatrix} f_R \\ f_r \end{bmatrix} = [H][G]\begin{bmatrix} d_R \\ d_L \end{bmatrix}$$

In this equation, the right output channel $f_R$ and the left output channel $f_L$ produced at the right and left ears of the listener, respectively, are substantially similar or identical to the right audio input channel $d_R$ and a left audio input channel $d_L$, respectively.

In one embodiment, the audio receiver 3 stores a plurality of beam pattern matrices corresponding to different locations of one or more listeners 6 in the room 7 relative to the speaker array 4. For example, the audio receiver 3 may store a separate beam pattern matrix for each coordinate pair x, y, representing the location of the listener 6 in the room 7 relative to the speaker array 4. As noted above, the beam pattern matrices may be associated with locations of multiple listeners 6 in the room 7.

In one embodiment, the beam pattern matrices may be stored in a local medium in the audio receiver 3. For example, the beam pattern matrices may be stored in a microelectronic, volatile or non-volatile medium integrated within the audio receiver 3. In another embodiment, the beam pattern matrices are located on a remote server or system and are accessible by the audio receiver 3 using a wired or wireless network connection. For example, the audio receiver 3 may access the beam pattern matrices using one or more of IEEE 802.11x, IEEE 802.3, cellular Global System for Mobile Communications (GSM), cellular Code division multiple access (CDMA), and Long Term Evolution (LTE).

As noted above, the beam pattern matrices may maximize sound intended for the right and left ears of the listener 6 based on the location of the listener 6 while minimizing sound in all other areas of the room 7. In one embodiment, each of the beam pattern matrices consist of a set of complex values describing filters (e.g., magnitudes and phases) for a particular frequency for driving corresponding transducers 5 in the speaker array 4 to produce left and right audio channels. For example, a beam pattern matrix may be represented as:

$$\begin{bmatrix} r_{R1} & r_{R2} & \cdots & r_{Rt} \\ r_{L1} & r_{L2} & \cdots & r_{Lt} \end{bmatrix}$$

In the above sample beam pattern matrix, each r corresponds to complex filter values describing magnitudes and phases applied to each of the t transducers 5 in the speaker array 4 for the left and right audio channels for a particular frequency. As described above, the crosstalk canceller 16 retrieves a beam pattern matrix for each of one or more desired frequencies corresponding to the detected location of the listener 6. The retrieved beam pattern matrices are fed to the array processor 14 for processing one or more channels of audio representing a piece of sound program content. Although the equations used herein are described in the frequency domain, the filter values in the beam pattern matrices may be implemented in either the time or frequency domain.

The complex filter values describe magnitudes and phases of sound to be emitted by each of the transducers 5 to achieve one or more predefined constraints, which were used to originally calculate the beam pattern matrices. As noted above, the constraints may include (1) maximizing/increasing a left channel and minimizing/decreasing a right channel of a piece of sound program content at the left ear of the listener 6, (2) maximizing/increasing the right channel and minimizing/decreasing the left channel at the right ear of the listener 6, and (3) minimizing/decreasing sound in all other areas of the room 7. These constraints cause the audio receiver 3 to beam sound towards the listener 6. By beaming sound towards the listener 6 and not in other areas of the room 7, crosstalk cancellation is achieved with minimal effects due to changes to the frequency response of the room 7.

Upon retrieving one or more beam pattern matrices for a set of frequencies corresponding to the current location of the listener 6, the crosstalk canceller 16 feeds the beam pattern matrix to the array processor 14. The array processor 14 processes each of the audio channels of a piece of sound program content received from the multiplexer 12 according to the beam pattern matrices. For example, the array processor 14 may use each complex filter value in the beam pattern matrices as weighting and phase values for corresponding audio signals fed to transducers 5 in the speaker array. The array processor 14 causes the transducers 5 to emit sound based on the filter values in the beam pattern matrices such that each of the constraints is achieved (e.g., (1) maximizing a left channel and minimizing a right channel of a piece of sound program content at the left ear of the listener 6, (2) maximizing the right channel and minimizing the left channel at the right ear of the listener 6, (3) and minimizing sound in all other areas of the room 7).

By maximizing sound directed at the listener 6, the room 7 has little impact on the listener 6 as sound is minimized in most areas of the room 7. Additionally, crosstalk cancellation is less likely to be effected by ill-conditioned cases (e.g., transducer 5 sensitivity changes and room 7 effects) as there are many more degrees of control (i.e., many transducers 5 in the speaker array 4) that may be used for adjustment.

The array processor 14 may operate in both the time and frequency domains using transforms such as the Fast Fourier Transform (FFT). The array processor 14 may be a special purpose processor such as an application-specific integrated circuit (ASIC), a general purpose microprocessor, a field-programmable gate array (FPGA), a digital signal controller, or a set of hardware logic structures (e.g., filters, arithmetic logic units, and dedicated state machines). As shown in FIG. 3, the processed segment of the sound program content is passed from the array processor 14 to the one or more digital-to-analog converters 21 to produce one or more distinct analog signals. The analog signals produced by the digital-to-analog converters 21 are fed to the power amplifiers 22 to drive selected transducers 5 of the loudspeaker array 4.

The audio receiver 3 may continually adjust the output of the speaker array 4 based on the detected movement of the listener 6 by the location estimator 15. For example, upon detecting that the listener 6 has moved, the crosstalk canceller feeds an updated set of beam pattern matrices to the array processor 14 for processing.

Figure 5A:
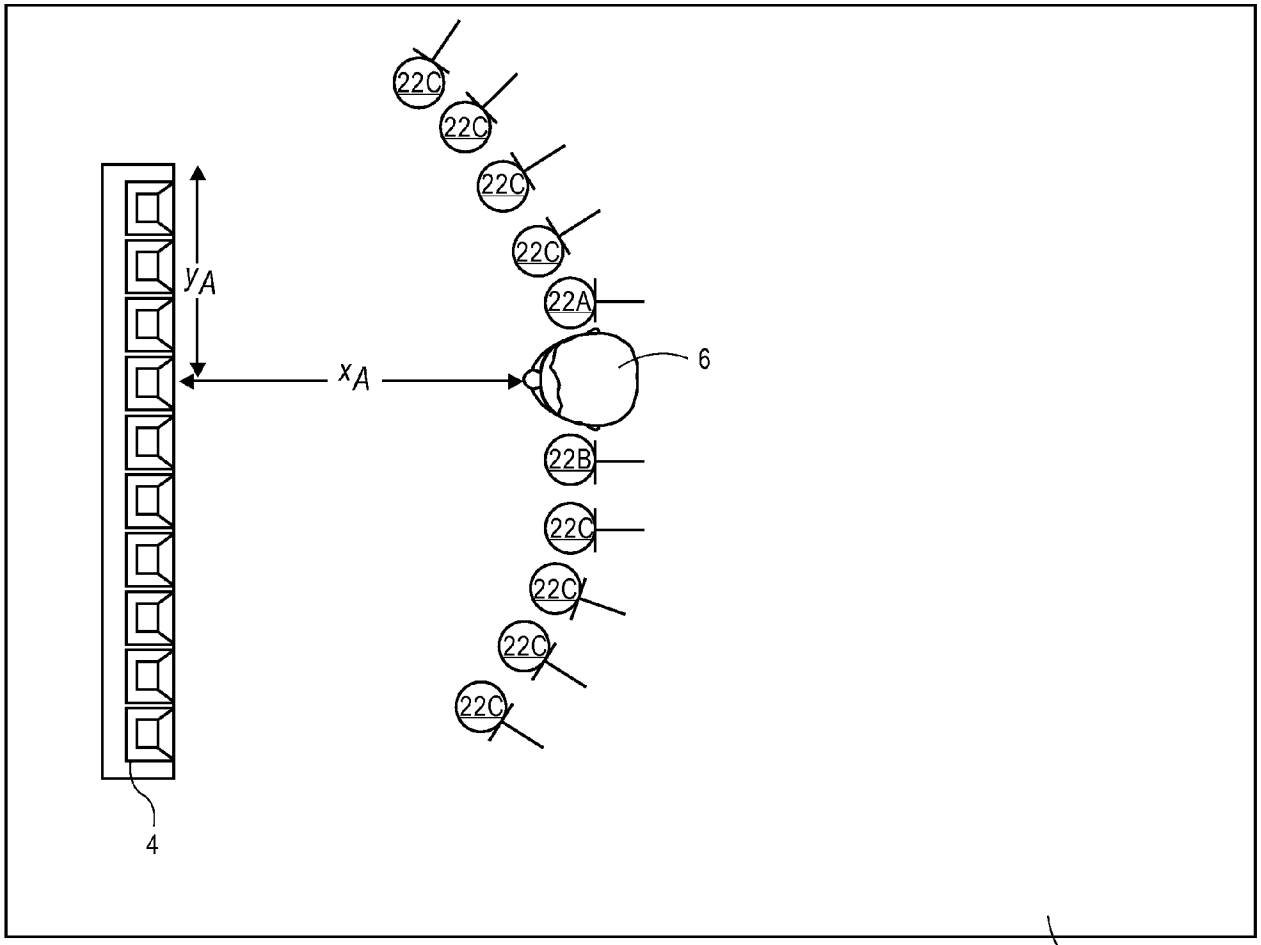
FIG. 5A shows a system for generating beam pattern matrices for a single listener using a set of microphones according to one embodiment.
Figure 5B:
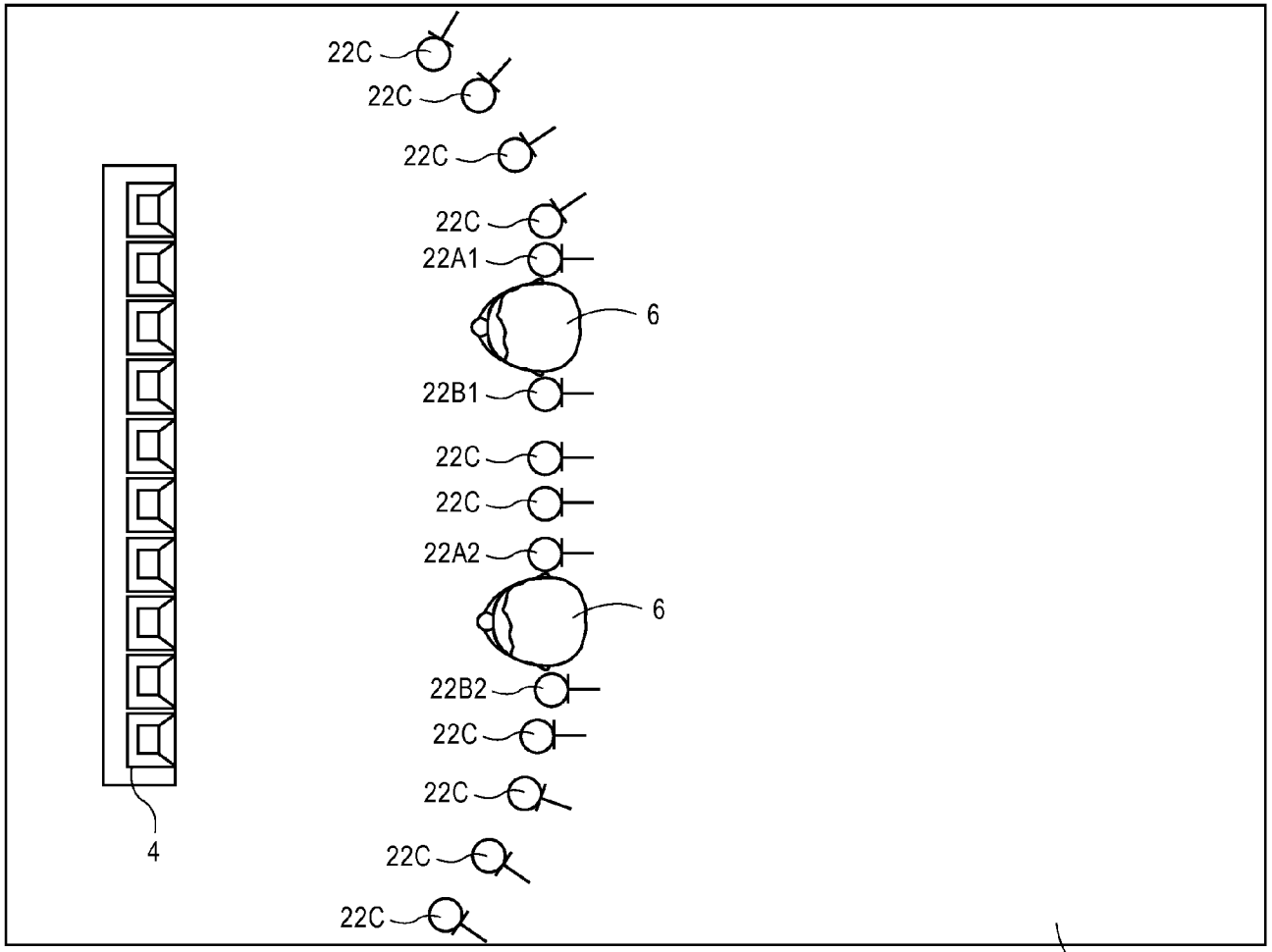
FIG. 5B shows a system for generating beam pattern matrices for multiple listeners using a set of microphones according to one embodiment.

Turning now to FIGS. 5A and 5B, a system for generating the beam pattern matrices will be described. The beam pattern matrices may be generated by the audio receiver 3 during initial configuration of the audio system 1 or by a separate unit in a manufacturing or laboratory facility. In the description below, the generation of the beam pattern matrices will be described in relation to the audio receiver 3. However, in other embodiments a separate device may be used to calculate and provide these matrices to one or more audio receivers.

The crosstalk canceller 16 generates one or more beam pattern matrices for a set of frequencies based on the location of the listener 6 in the room 7. In one embodiment, the audio receiver 3 includes one or more microphones 22 for assisting in generating the beam pattern matrices. The microphones 22 may include the microphone 18 used to determine the location of the listener 6 or the microphones 22 may be separate from microphone 18. The microphones 22 are used initially to calibrate the audio receiver 3 and the loudspeaker arrays 4 in the room 6. The microphones 22 may be removed/stored once the beam pattern matrices have been generated.

As shown in FIG. 5A, the microphone 22A is positioned to represent the right ear of the listener 6, the microphone 22B is positioned to represent the left ear of the listener 6, and the microphones 22C are positioned in other areas of the room 7 separate from the microphones 22A and 22B. In another embodiment shown in FIG. 5B, the microphones may be positioned to represent multiple listeners 6. For example, the microphones $\mathbf{22}A_1$ and $\mathbf{22}B_1$ are positioned to represent the right and left ears of a first listener 6, the microphones $\mathbf{22}A_2$ and $\mathbf{22}B_2$ are positioned to represent the right and left ears of a second listener, and the microphones 22C are positioned in other areas of the room 7 separate from the microphones $\mathbf{22}A_1$, $\mathbf{22}B_1$, $\mathbf{22}A_2$, and $\mathbf{22}B_2$. Although described below with reference to a single listener 6, the crosstalk matrix generator 16 may operate with multiple listeners 6 in a similar fashion.

The microphones 22 may be coupled to the crosstalk canceller 16 using a wired or wireless connection. In one embodiment, the microphones 22 are integrated in a mobile device (e.g., a mobile phone) and the sensed sounds are transmitted to the crosstalk canceller 16 using one or more wireless protocols (e.g., BLUETOOTH and IEEE 802.11x). The microphones 22 may be any type of acoustic-to-electric transducer or sensor, including MicroElectrical-Mechanical System (MEMS) microphones, piezoelectric microphones, electret condenser microphones, or dynamic microphones. The microphones 22 may provide a range of polar patterns, such as cardioid, omnidirectional, and figure-eight. In one embodiment, the polar patterns of the microphones 22 may vary continuously over time.

In one embodiment, the audio receiver 3 produces a series of test sounds used to drive the transducers 5 in the speaker array 4. The test sounds may be variable in duration, frequency, and power and may be separated into a right channel and a left channel corresponding to the left and right ears of the listener 6. Using the microphone layout shown in FIG. 5A, the crosstalk matrix generator 16 calculates a beam pattern matrix for each frequency in a set of frequencies. The generated beam pattern matrices drive each of the transducers 5 in the speaker array 4 based on one or more constraints. In one embodiment, the constraints include (1) maximizing/increasing the left channel and minimizing/decreasing the right channel of a piece of sound program content at the microphone 22A, (2) maximizing/increasing the right channel and minimizing/decreasing the left channel at the microphone 22B, and (3) generating no sound or very low levels of sound at the microphones 22C. For example, for a right channel test sound $z_L$ and a left channel test sound $z_R$, the above described constraints would yield sensed sounds for microphones 22A and 22B identical to the right channel test sound $z_R$ and the left channel test sound $z_L$, respectively, while the microphones 22C would sense nearly no sound. Using the above constraints, the crosstalk generator 16 may calculate beam pattern matrices that accurately produce the right channel and the left channel at the left and right ears of the listener 6, respectively, without allowing sound from opposing channels to bleed into the left and right ears.

Figure 6:
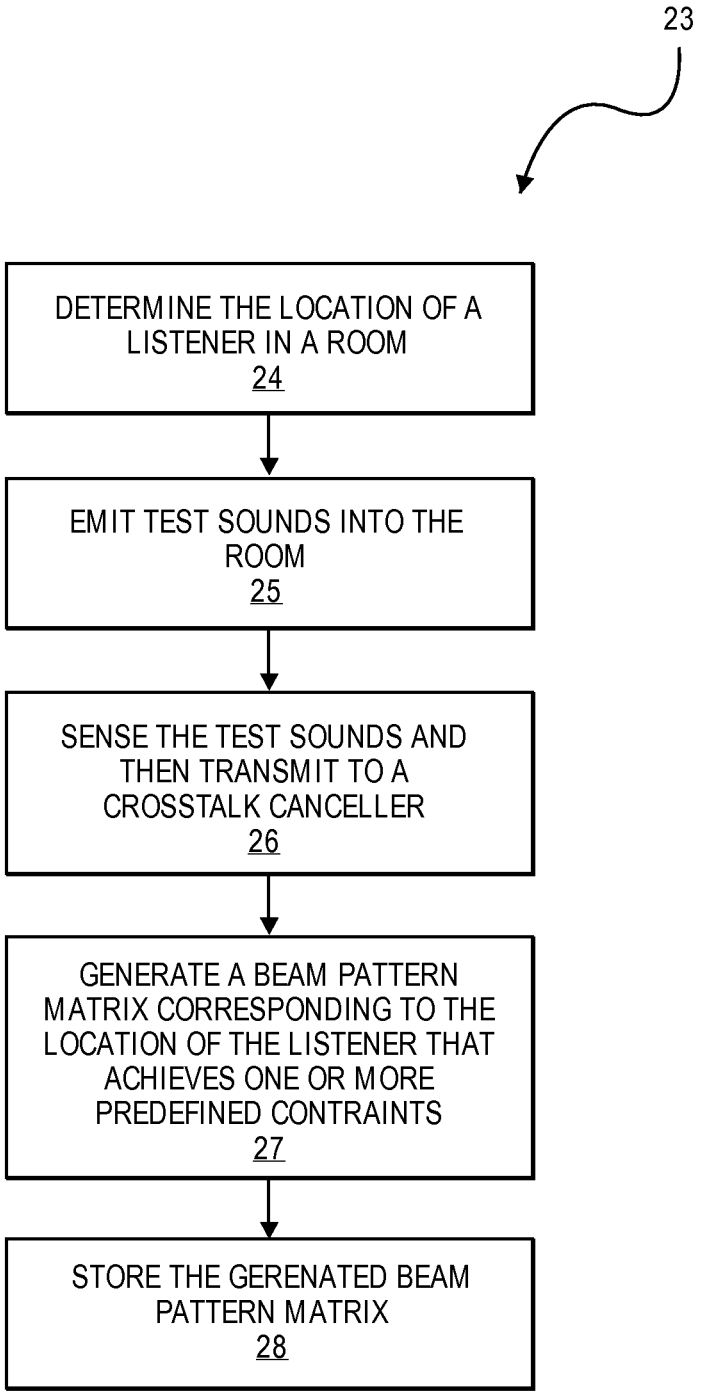
FIG. 6 shows a method for generating beam pattern matrices using the microphone configuration shown in FIGS. 5A and 5B according to one embodiment.

FIG. 6 shows a method 23 for generating beam pattern matrices using the microphone configuration shown in FIGS. 5A and 5B according to one embodiment. The method 23 begins at operation 24 with the determination of the location of the listener 6 in the room 7. The listener 6 in this operation may not be an actual listener 6, but instead the position of microphones 22A and 22B that represent the ears of the listener 6. In one embodiment, the location estimator 15 may determine the location of the listener 6 using one or more of the user input device 17, the microphone 18, the camera 19, and the IR sensors 20. The location of the listener 6 may be represented as coordinates relative to the speaker array 4 or any other known fixture in the room 7.

Upon the determination of the location of the listener 6, a plurality of test sounds are emitted by the audio receiver 3 into the room 7 at operation 25. The test sounds are separated into a right channel $z_R$ and a left channel $z_L$ corresponding to right and left ears of the listener 6, respectively. The test sounds may be variable in duration, frequency, and power for each channel $z_R$ and $z_L$.

At operation 26, the microphones 22 sense the test sounds as they permeate through the room 7 and the sensed sounds are transmitted to the crosstalk canceller. As described above and shown in FIG. 5A, the microphone 22A is positioned to represent the right ear of the listener 6, the microphone 22B is positioned to represent the left ear of the listener 6, and the microphones 22C are positioned in other areas of the room 7 separate from the microphones 22A and 22B. The sensed sounds may be transmitted to the crosstalk canceller using a wired or wireless connection.

At operation 27, the sensed sounds from each of the microphones 22 are fed to the crosstalk matrix generator 16 to generate a beam pattern matrix corresponding to the location of the listener 6. The crosstalk matrix generator 16 calculates beam pattern matrices that seek to achieve a set of predefined constraints. The beam pattern matrices include a set of complex filter values describing magnitudes/weights and phases to be applied to audio signals applied to each transducer 5 in the speaker array 4 to achieve the one or more constraints. In one embodiment, the constraints include (1) maximizing the left channel and minimizing the right channel of a piece of sound program content at the microphone 22A, (2) maximizing the right channel and minimizing the left channel at the microphone 22B, (3) and generating no sound or very low levels of sound at the microphones 22C. To achieve these constraints, the problem may be formulated as a least squares problem, where a large weighting is applied to the part of the beam pattern matrix relating to maximizing and minimizing the right and left channels at the microphone 22A, 22B, respectively, (e.g., crosstalk cancellation) while a comparatively smaller weighting is applied to the part of the beam pattern matrix relating to minimizing sound at the microphones 22C. The overall effect is that the method 23 achieves crosstalk cancellation while minimizing sound away from the listener 6.

In one embodiment, the transfer function for the room 7 corresponding to the location of the listener 6 is determined. The determined transfer function is used during the generation of the beam pattern matrices to compensate for effects/disturbances caused by the test sounds propagating through the room 7.

At operation 28, the calculated beam pattern matrices may be stored and/or transmitted to one or more audio receivers 3 for performing crosstalk cancellation as described above in various rooms and environments. The transmission may be performed over a wired or wireless connection. In one embodiment, the calculated beam pattern matrices are stored on other audio receivers 3 during their production in a manufacturing facility.

The method 23 may be continually performed for multiple possible locations of the listener 6 such that corresponding beam pattern matrices may be generated for a set of frequencies. Each of the beam pattern matrices for each corresponding location may be transmitted to one or more audio receivers 3 for performing crosstalk cancellation as described above using one or more constraints. Using the above described constraints, the crosstalk generator 16 may calculate beam pattern matrices that accurately produce the right channel and the left channel at the left and right ears of the listener 6, respectively, without allowing sound from opposing channels to bleed into the left and right ears of the listener 6.

As explained above, an embodiment of the invention may be an article of manufacture in which a machine-readable medium (such as microelectronic memory) has stored thereon instructions which program one or more data processing components (generically referred to here as a "processor") to perform the operations described above. In other embodiments, some of these operations might be performed by specific hardware components that contain hardwired logic (e.g., dedicated digital filter blocks and state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A method of performing crosstalk cancellation, comprising:

identifying a location of a listener in a room;

retrieving a previously stored set of beam pattern matrices corresponding to the identified location of the listener from a storage that contains a plurality of beam pattern matrices, each of the plurality of beam pattern matrices corresponding to a particular audio frequency, and each of the plurality of beam pattern matrices having been compensated for effects caused by test sounds propagating through the room during the generation of the plurality of beam pattern matrices using a transfer function for the room; and driving a speaker array to produce a set of beam patterns based on the retrieved beam pattern matrices, wherein the retrieved beam pattern matrices cause the beam patterns to (1) increase a left channel and decrease a right channel of a piece of sound program content at the left ear of the listener, (2) increase the right channel and decrease the left channel at the right ear of the listener, and (3) decrease sound power in all other areas of the room.

2. The method of claim 1, wherein identifying the location of the listener in the room comprises performing face detection and tracking.

3. The method of claim 1, further comprising:

repeatedly identifying the location of the listener in the room while the piece of sound program content continues to be played back.

4. The method of claim 3, further comprising:

upon determining that the listener has moved to a different location in the room based on the repeated identification, retrieving a new set of beam pattern matrices corresponding to the different location of the listener.

5. The method of claim 4, further comprising:

driving the speaker array to produce a set of beam patterns based on the retrieved new set of beam pattern matrices.

6. The method of claim 1, wherein each beam pattern matrix is a set of filter values corresponding to a frequency for driving each transducer in the speaker array.

7. The method of claim 1, wherein the plurality of beam pattern matrices in the storage each correspond to distinct locations in the room relative to the speaker array and an audio frequency.

8. The method of claim 7, wherein the plurality of beam pattern matrices are preset during manufacture of the speaker array.

9. A method for generating a beam pattern matrix that causes a speaker array to provide a beam pattern corresponding to a particular audio frequency, comprising:

positioning a first set of microphones in a room, wherein the first set of microphones are positioned to simulate a location of the left ear of a listener;

positioning a second set of microphones in the room, wherein the second set of microphones are positioned to simulate a location of the right ear of the listener;

positioning a third set of microphones in the room separate from the first and second sets of microphones;

driving a speaker array with a left audio channel and a right audio channel;

determining a set of beam patterns that (1) maximize the left audio channel and minimizes the right audio channel at the first set of microphones, (2) maximize the right audio channel and minimizes the left audio channel at the second set of microphones, (3) and minimizes sound sensed by the third set of microphones;

determining a transfer function for the room; and generating the beam pattern matrix to represent the beam patterns as a set of real values for driving the speaker array for a particular frequency, utilizing the transfer function during the generation of the beam pattern matrix to compensate for effects caused by the right audio channel and the left audio channel propagating through the room.

10. The method of claim 9, further comprising:

repositioning the first, second, and third sets of microphones to simulate a new location of the listener in the room;

determining a new set of beam patterns that (1) increase the left audio channel and decrease the right audio channel at the first set of microphones, (2) increase the right audio channel and decrease the left audio channel at the second set of microphones, and (3) decrease sound sensed by the third set of microphones; and generating a new beam pattern matrix to represent the new set of beam patterns as a set of real values for driving the speaker array for a particular frequency.

11. The method of claim 9, further comprising:

providing the beam pattern matrix to an audio device for use in a different room.

12. The method of claim 9, wherein the set of beam patterns are determined using a least squares algorithm, where a large weight is applied to maximizing and minimizing the left and right audio channels at the first and second sets of microphones, respectively, and a smaller weight is applied to the third set of microphones.

13. The method of claim 9, wherein the transfer function for the room is determined corresponding to the location of the listener.

14. A system for generating a beam pattern matrix that causes a speaker array to provide a beam pattern corresponding to a particular audio frequency, comprising:

a first set of microphones representing the left ear of a listener, wherein the listener is located in a room;

a second set of microphones representing the right ear of the listener;

a third set of microphones representing other areas of a room in which the listener is located; and an audio processor for determining a set of beam patterns for a speaker array that produce a left audio channel at the first set of microphones and a right audio channel at the second set of microphones while minimizing sound sensed by the third set of microphones, wherein the audio processor determines a transfer function for the room, generates the beam pattern matrix to represent the beam patterns as a set of real values for driving the speaker array, and utilizes the transfer function during the generation of the beam pattern matrix to compensate for effects caused by the right audio channel and the left audio channel propagating through the room.

15. The system of claim 14, wherein the set of beam patterns are determined by the audio processor using a least squares algorithm, where a large weight is applied to producing the left audio channel at the first set of microphones and the right audio channel at the second set of microphones while a smaller weight is applied to the third set of microphones.

16. The system of claim 15, further comprising:

a transmission unit for transmitting the beam pattern matrix to an external device for use in a different room.

17. The system of claim 14, wherein the transfer function for the room is determined corresponding to the location of the listener.

18. An article of manufacture, comprising:

a machine-readable storage medium that stores instructions which, when executed by a processor in a computing device, identify a location of a listener in a room;

retrieve a previously stored beam pattern matrix corresponding to the identified location of the listener from a storage that contains a plurality of beam pattern matrices, each of the plurality of beam pattern matrices corresponding to a particular audio frequency, and each of the plurality of beam pattern matrices having been compensated for effects caused by test sounds propagating through the room during the generation of the plurality of beam pattern matrices using a transfer function for the room; and drive a speaker array to produce a set of beam patterns based on the retrieved beam pattern matrix, wherein the retrieved beam pattern matrices cause the beam patterns to (1) increase a left channel and decrease a right channel of a piece of sound program content at the left ear of the listener, (2) increase the right channel and decrease the left channel at the right ear of the listener, and (3) minimizes sound in all other areas of the room.

19. The article of manufacture of claim 18, wherein the location of the listener in the room is identified using face detection and tracking.

20. The article of manufacture of claim 18, wherein identification of the location of the listener is continually performed while of the piece of sound program content is being played to a listener.

21. The article of manufacture of claim 20, wherein upon determining movement of the listener to a new location in the room, retrieving a new beam pattern matrix corresponding to the new identified location of the listener.

22. The article of manufacture of claim 21, further comprising:

driving the speaker array to produce a set of beam patterns based on the retrieved new beam pattern matrix.

23. The article of manufacture of claim 18, wherein the beam pattern matrix is a set of complex filter values for driving each transducer in the speaker array for a particular frequency.

24. A non-transitory machine readable medium storing executable instructors which when executed by a data processing system cause the data processing system to perform a method of performing crosstalk cancellation, the method comprising:

identifying a location of a listener in a room;

retrieving a previously stored set of beam pattern matrices corresponding to the identified location of the listener from a storage that contains the set of beam pattern matrices, each of the plurality of beam pattern matrices corresponding to a particular audio frequency, and each of the plurality of beam pattern matrices having been compensated for effects caused by test sounds propagating through the room during the generation of the plurality of beam pattern matrices using a transfer function for the room; and driving a speaker array to produce a set of beam patterns based on the retrieved set of beam pattern matrices, wherein the retrieved set of beam pattern matrices cause the beam patterns to (1) increase a left channel and decrease a right channel of a piece of sound program content at the left ear of the listener, (2) increase the right channel and decrease the left channel at the right ear of the listener, and (3) decrease sound power in all other areas of the room.

25. The medium of claim 24, wherein identifying the location of the listener in the room comprises performing face detection and tracking.

26. The medium of claim 24, the method further comprising:

repeatedly identifying the location of the listener in the room while the piece of sound program content continues to be played back.

27. The medium of claim 26, the method further comprising:

upon determining that the listener has moved to a different location in the room based on the repeated identification, retrieving a new set of beam pattern matrices corresponding to the different location of the listener.

28. The medium of claim 24, wherein each beam pattern matrix is a set of filter values corresponding to a frequency for driving each transducer in the speaker array.

* * * * *